US005445002A

United States Patent [19]

Cudini et al.

[11] Patent Number: 5,445,002

[45] Date of Patent: Aug. 29, 1995

[54] FILL AND PRESSURIZATION APPARATUS

[75] Inventors: Ivano G. Cudini; Murray R. Mason; Gerrald A. Klages, all of Woodstock, Canada

[73] Assignee: TI Corporate Services Limited, London, England

[21] Appl. No.: 106,751

[22] Filed: Aug. 16, 1993

[51] Int. Cl.[6] ..... B21D 39/08

[52] U.S. Cl. ..... 72/62; 72/58; 29/421.1

[58] Field of Search ..... 72/58, 61, 62; 29/421.1

[56] References Cited

U.S. PATENT DOCUMENTS

| | | | |
|---|---|---|---|
| 2,458,854 | 1/1949 | Hull et al. . | |
| 2,837,810 | 6/1958 | Ekholm . | |
| 3,287,949 | 11/1966 | Skinner | 72/62 |
| 3,542,076 | 11/1970 | Richardson | 72/58 |
| 4,006,619 | 2/1977 | Anderson | 72/58 |
| 4,393,674 | 7/1983 | Rasmussen | 72/61 |
| 4,460,200 | 7/1984 | Rasmussen et al. | 285/81 |
| 4,730,474 | 3/1988 | Iwakura et al. | 72/61 |
| 5,233,854 | 8/1993 | Bowman et al. | 72/58 |
| 5,233,856 | 8/1993 | Shimanovski et al. | 72/62 |
| 5,235,836 | 8/1993 | Klages et al. | 72/62 |
| 5,239,852 | 8/1993 | Roper | 72/58 |
| 5,357,774 | 10/1994 | Klages et al. | 72/62 |

FOREIGN PATENT DOCUMENTS 57-165134 10/1982 Japan .

*Primary Examiner*—David Jones

*Attorney, Agent, or Firm*—Ridout & Maybee

[57] ABSTRACT

Fill and pressurization apparatus having a sectional fluid conductor having a first section fixed relative to the surroundings, and a second section which moves toward the first section to form an enclosure through which a high volume flow rate—low pressure flow may be passed to fill an adjacent open end of a tube with liquid. Said fluid is passed through an inlet conduit, which may be a rigid conduit, to the fixed first section. A seal head insertable into the end of the filled tube has an elastomeric seal member and a rod and a sleeve relatively axially displaceable to compress the seal member and deform it into sealing engagement with a surface of the tube. A stop member on one of the rod and sleeve and a stop surface on the other of the rod and sleeve limit the axial displacement and hence also the compressive force applied to the seal member. The relative displacement is achieved by retracting one of the rod and the sleeve and blocking the retraction of the other. The blocking is provided by two telescoping cylinders, one of which has abutments thereon running in channels provided in the other cylinder. To effect blocking one cylinder is rotated relative to the other so that the abutments are out of register with the channels and engage stop surfaces in an extended condition of the cylinders relative to one another.

19 Claims, 5 Drawing Sheets

FILL AND PRESSURIZATION APPARATUS

The present invention relates to improvements in the fill and pressurization apparatus described in commonly assigned U.S. patent application serial No. 07/860,553 in the name Klages et al filed Mar. 30, 1992 now U.S. Pat. No. 5,235,836, issued Aug. 17, 1993. Such fill and pressurization apparatus may be useful in, by way of non-limiting example, expansion forming such as described in commonly assigned U.S. Pat. Nos. 4,567,743 dated Feb. 4, 1986, Re. 33990 and Mason et al patent application Ser. No. 08/106,752 filed Aug. 16, 1993. Other uses are contemplated such as pressure testing of tubing.

In one aspect, the invention provides a fill and pressurization apparatus for filling and pressurizing a hollow tube through an end thereof comprising:

(a) a sectional fluid conductor comprising a first conductor section fixed relative to the surroundings and at least one further conductor section movable with respect to the first section between relatively open and closed positions, an inlet in the first section in communication with a high flow—low pressure circuit and said conductor in the closed position being adapted to define a fluid conduit between said circuit and the open end of the tube, and (b) a movable shaft having a bore in communication with a low flow—high pressure circuit, said shaft movable into a pressurizing position communicating said bore with the interior of the hollow tube and separating said fluid conduct therefrom.

With this arrangement, the high flow—low pressure fill is provided through an inlet which is fixed relative to the surroundings, so that the need is avoided for the use of flexible conduits capable of travelling with the fluid conductor. In the invention, a rigid conduit may be connected between the low pressure source and the fixed conductor section whereby the use of relatively inconvenient, expensive and unreliable flexible conduiting connected to the low pressure source can be avoided.

In a further aspect, the invention provides apparatus for sealing a hollow tube comprising a rod, a sleeve outwardly of the rod, an endless elastomeric seal member disposed around the rod and adapted to be compressed between opposing compression surfaces provided on the rod and sleeve respectively when the rod and sleeve are displaced axially relative to one another whereby the seal member extends in a radial direction to engage sealingly on a surface of the tube, and means for limiting the compression applied to the seal member comprising a stop surface provided on one of the rod and sleeve and a stop member on the other of the rod and sleeve and moving therewith and engaging the stop surface on predetermined axial relative movement between the rod and sleeve. This arrangement allows for simplification of the apparatus since external means for limiting axial displacement of the sleeve and rod are no longer required. Such sealing apparatus may be used together with known forms of pressurization device. In the preferred form, however, the rod is provided with a bore through which the sealed tube may communicate with a pressurization source.

In a still further aspect, the invention provides apparatus for sealing a hollow tube comprising a rod, a sleeve outwardly of the rod, an endless elastomeric seal member disposed around the rod, means for retracting one of the rod and sleeve and means for blocking retraction of the other of the rod and sleeve whereby the rod and sleeve are displaced axially relative to one another and the seal member compressed to extend in a radial direction for sealing on a tube surface, said blocking means comprising two telescoping cylinders and means for resisting thrust forces applied to said cylinders in extended condition, said cylinders engaging said other of the rod and sleeve, one cylinder provided with abutment members extending radially and running in axially extending channels provided in the other cylinder, stop surfaces extending circumferentially from the channels adjacent the abutment members in said extended position of the cylinders relative to one another, and means for rotating the cylinders relative to one another whereby the abutment members lodge on the stop surfaces to block telescoping movement of the cylinders. This allows further simplification of the apparatus in that external blocking devices for resisting thrust exerted during compression of the sealing member do not need to be used.

A presently preferred form of fill and pressurization apparatus embodying the above aspects of the invention is described in more detail below, by way of example only, with reference to the accompanying drawings.

Figure 1:
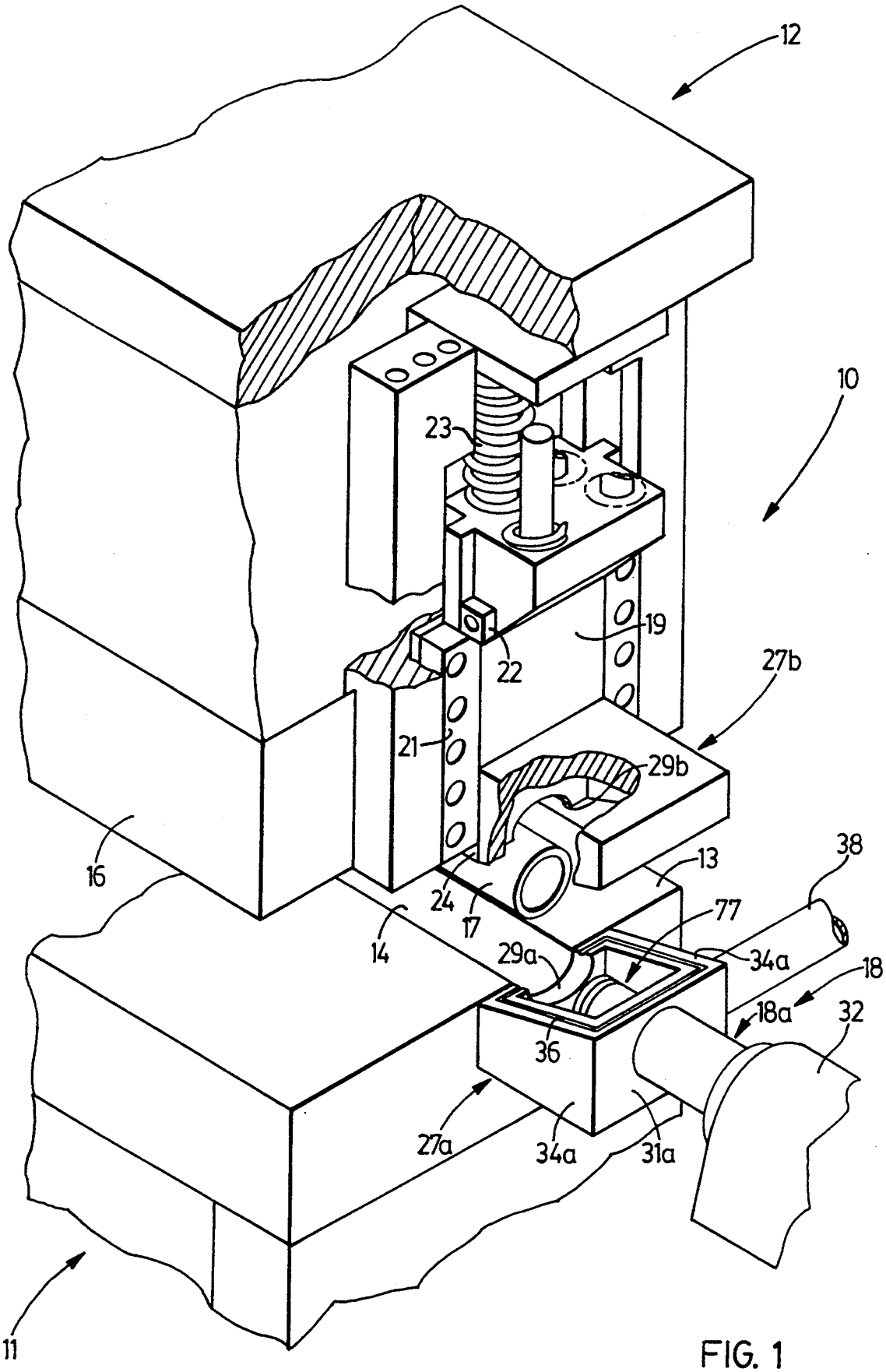
FIG. 1 is a partial perspective view illustrating a die for expansion forming of tubing together with fill and pressurization apparatus in open position.
Figure 2:
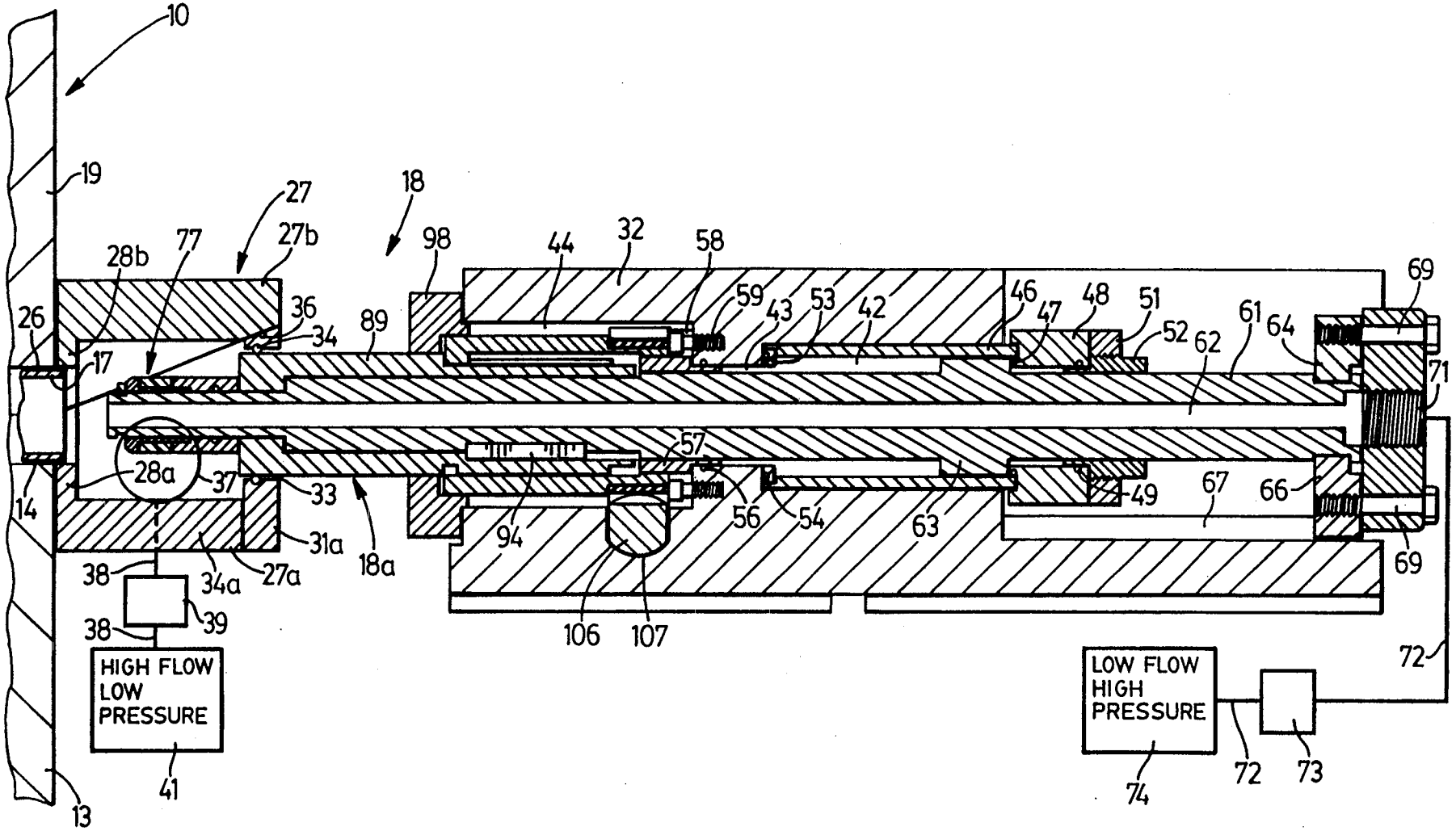
FIG. 2 is partial longitudinal cross-section through the die and apparatus of FIG. 1, showing the fill apparatus in closed position and the pressurization device in retracted condition.

Referring to FIGS. 1 and 2 an expansion forming die 10 is shown having a lower portion 11 supported on and fixed to the surroundings such as the shop floor and an upper portion 12 movable up and down with respect thereto by press structure (not shown). For example, the lower portion 11 may be connected to a fixed frame supported on the floor. Generally the die may be similar to that described in co-pending Mason et al patent application Ser. No. 08/106,752 filed Aug. 16, 1993 the disclosures of which are incorporated herein by reference. Briefly, the lower portion 11 comprises a lower die section 13 with a generally trough-shaped die cavity portion 14 therein. An upper die section 16 is also provided with a die cavity portion and when the sections are closed together an open-ended die cavity is formed within which a hollow tube or tubular blank 17 may be expanded and formed. The blank 17 is placed between the die sections before closure, and is filled with liquid (usually water) and is pressurized using fill and pressurization apparatus provided at each end of the die 10 and indicated at one end generally at 18. The pressurization is sufficient to expand the blank 17 to form a replica of the die cavity.

A clamp member 19 is mounted at each end of the upper die section. FIGS. 1 and 2 show the clamp member 19 at one end but it will be appreciated a similar arrangement is used at the opposite end. Member 19 is supported through a lost motion linkage comprising vertical slide structure 21 and a stop 22 such that member 19 is slidable vertically with respect to section 16 to a downward extent limited by the stop 22. Compression springs 23 normally urge the member 19 downwardly to the limiting position shown in FIG. 1 wherein the lower end 24 of member 19 projects downwardly beneath the upper section 16.

On closure of upper section 16 to an intermediate position, wherein the opposing surfaces of sections 13 and 16 are separated by a small distance, usually about 10 to about 25% of the diameter of the blank 17, lower end 24 of clamp member 19 engages section 13 and is urged upwardly against the action of the springs 23. The resilient reaction causes the end of blank 17 to be tightly gripped between the adjacent end portion of the lower cavity 14 and an arcuate cavity portion 26 formed in the lower side of member 19.

In the case in which the blank 17 is to be formed to a cross section which is of oblong rectangular profile it is desirable to initially form an end of the blank 17 to an elongated smoothly arcuate profile such as a smoothly rounded hourglass or elliptical profile. In such case desirably the end portion of the cavity 14 and the cavity 26 are effective to deform the end of the blank 17 to such elongated profile. Otherwise, the member 19 and cavity 14 may grip the end of the blank 17 tightly without substantial deformation. In the example illustrated in the drawings, the end of the blank 17 is deformed initially to an elliptical cross-sectional profile.

As shown in the drawings, a box-shaped high flow—low pressure fluid conduit 27 is provided. A similar arrangement is provided at each end of the apparatus 10. The conduit 27 is formed by a sectional fluid conductor comprising a first or lower conductor section 27*a* fixed to the lower section 13 and a second or upper section 27*b* connected to the member 19. These sections unite in the intermediate closure position shown in FIG. 2 to form a closed box.

Each section 27*a* and 27*b* may be of similar construction and preferably each comprises a front wall 28*a* or 28*b* that facilitates securement of the sections 27*a* and 27*b* to the section 13 and member 19, respectively, for example with threaded studs or the like (not shown).

These front walls are formed with a partial cavity 29*a* and 29*b* matching the cavity portions 14 and 26 in the lower section 16 and member 19, respectively. Usually, there is some variation or tolerance in the lengths of tubular blanks 17 and in order to reduce the overall length of the apparatus 10, the dimensions of the walls 28*a* and 28*b* are such that, depending on the tolerance on the length of the blank, the end of the blank falls at a point along the thickness of the walls 28*a* and 28*b*. In the event that the ends of the blank 17 are deformed to an elongated profile on intermediate closure of the sections 11 and 12, the walls 28*a* and 28*b* react with the blank 17 to deform it to such profile. Preferably, the cavities 29*a* and 29*b* are each of size or extent sufficient to receive one half of the external perimeter of the tube 17. For example, each cavity 29*a* and 29*b* may be semi-elliptical. The front edge of each front wall 28*a* and *b* is substantially flush with the mating planes of the sections 13 and member 19, respectively, to facilitate placement of the blank 17 between sections 11 and 12 and removal of the formed blank from between the open sections 11 and 12 at the end of the forming cycle. The front wall 28*a* of the lower section 27*a* is relatively shallow while a rear wall 31*a* is relatively deep to accommodate a portion 18*a* of a seal head forming part of the apparatus 18, and described in more detail below. The portion 18*a* reciprocates axially of the cavity defined between the cavity portion 14 and 26 in the intermediate closure position described above and also with respect to a cylinder block 32 fixed with respect to the surroundings and the portion 11 and hence also fixed with respect to the section 27*a*. The portion 18*a* passes through an opening 33 in the wall 31*a* provided with an O-ring seal to guard against leakage of liquid around the portion 18*a*. The side walls 34*a* incline upwardly, toward the upper section 27*b*, rearwardly from the front toward the rear. The side walls of the upper section likewise taper from the front to the rear as seen in side view, so that the sections 27*a* and 27*b* mate together along a plane inclining upwardly rearwardly. The upper surface of the front wall 28*a*, rear wall 31*a* and side walls 34*a* are formed with a groove capturing a generally C-shaped resilient sealing gasket 36 that engages the lower surface of the walls of the upper section 27*b* guarding against leakage of liquid on closure of the sections 27*a* and *b* together.

One side wall 34*a* of the lower section 27*a* is formed with an inlet opening 37 to which is connected a relatively large diameter conduit 38 which is preferably a substantially rigid tube, for example it may be a metal pipe. As indicated somewhat schematically in FIG. 2, the conduit 38 connects through valving 39 to source 41 capable of delivering liquid at a relatively high flow rate and at a relatively low pressure.

In use, when the die portions 11 and 12 are closed together to the intermediate position, as illustrated in FIG. 2, the sections 27*a* and 27*b* form a box-like conduit or enclosure 27 about the mouth of the tube 17 gripped between the section 13 and member 19 whether in a deformed, such as elliptical, profile or in an original round or circular condition. Valving 39 may then be actuated to quickly fill the tube 17 through one end with liquid through the enclosure 27 from the source 41, at a high volume flow rate under low pressure, for example at slightly above atmospheric pressure. At the same time, valving similar to valving 39 connected to a conduit or enclosure similar to enclosure 27 may be actuated to vent the opposite end of the tube to the atmosphere, such vent then being closed at the completion of the liquid fill operation.

The filled tube 17 may then be sealed and pressurized using the sealing and pressurization apparatus described below, or using known forms of sealing and pressurization apparatus.

Modifications may of course be made to the apparatus described above in detail. For example, while an enclosure or conduit 27 having two sections has been described above, the upper, moving, section 27*b* may comprise two or more sub-sections moving independently or in unison from open position to closed positions defining a conduit or enclosure similar to the enclosure 27.

As noted above, the sealing and pressurization apparatus comprises a cylinder block 32 fixed relative to the surroundings, e.g. relative to a frame supported on the shop floor and supporting the lower portion 11. The block 32 has a bore through it comprising a rear portion 42, a somewhat narrow middle portion 43 and a wider front portion 44. The rear portion 42 provides a cylinder space housing a cylinder lining 46 closed at a rear end by an O-ring seal 47, a cylinder head end 48, an O-ring 49, a gland retainer 51 and a gland 52. The opposite end of the lining 42 is provided with a seal retainer 53, an O-ring seal 54, and is sealed through an O-ring 56, gland 57, and a thrust gland retainer 58 secured to the blank 32 with threaded studs 59.

Figure 4:
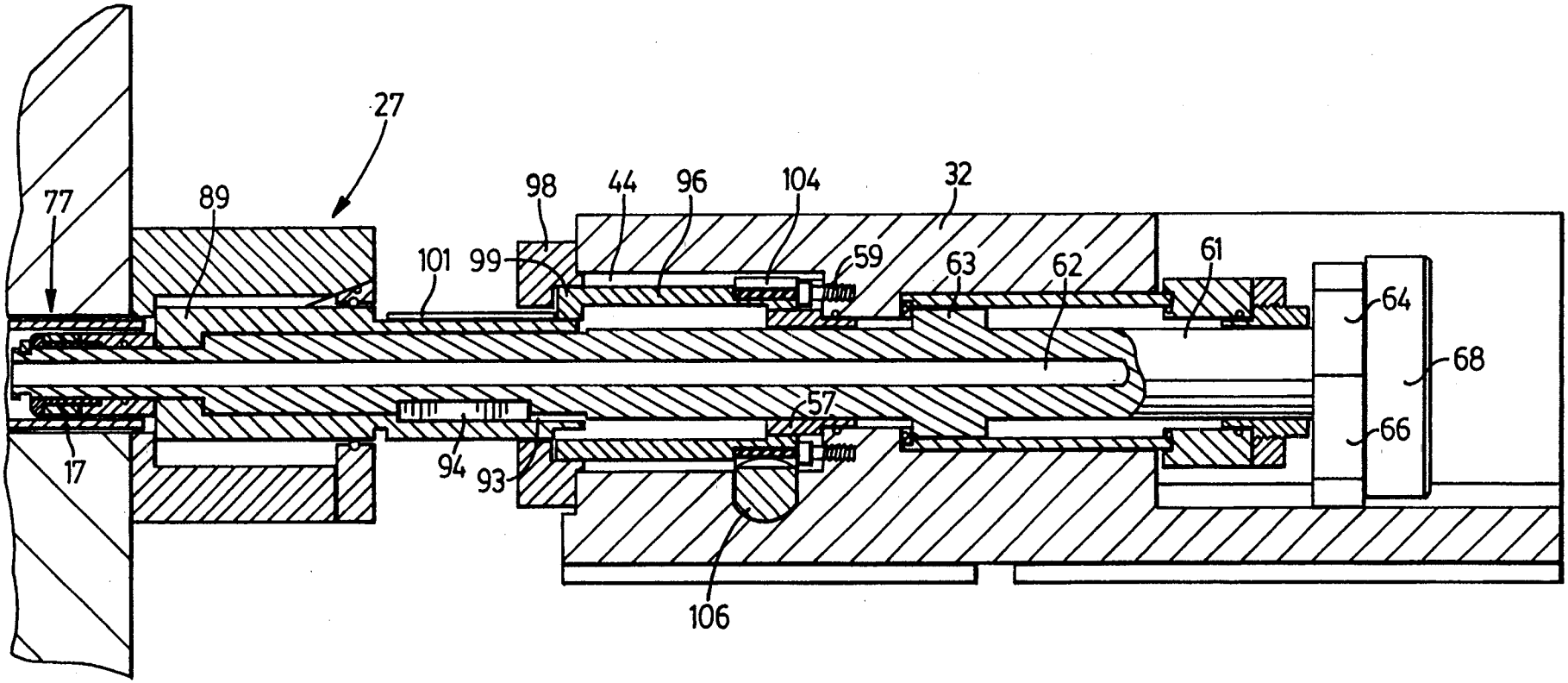
FIG. 4 is a view corresponding to FIG. 2 with the pressurization device in extended condition.

A rod 61 having a bore 62 through it passes through the block 32. The rod is formed with an enlarged piston portion 63 engaging snugly within the lining 46. Inlets adjacent the middle bore portion 43 and the cylinder head end 48 feed pressurized hydraulic fluid within the cylinder space to opposite sides of the piston portion 63 whereby the rod 61 may be reciprocated between retracted and advanced positions as seen in FIGS. 2 and 4, respectively.

Upper and lower mount portions 64 and 66 engage slots in the outer side of the rear of the rod 61 and are clamped in tight engagement in the rod 61 by fasteners such as a threaded stud disposed on each side of the rod out of the cross sectional plane of, and hence not seen in, FIG. 2. The sides of the portions 64 and 66 engage slidingly on surfaces 67 extending longitudinally on the block 32 and prevent rotation of the rod 61 about its axis. An inlet fitting 68 is secured to the mount portion 64 and 66 with threaded studs 69. The fitting 68 has a tapped opening 71 to which can be connected, through a threaded fixture, not shown, a flexible conduit 72 connected through valving 73 to a pressure intensifier or other source 74 of liquid, delivering a low flow rate of liquid at high pressures. The conduit 72 may be of relatively small diameter since it does not carry large volume flow rates.

The opposite or front end of the rod 61 has a relatively narrow stepped down diameter circular end portion 76 which carries a seal head generally indicated at 77. In the example illustrated, the head 77 is of elliptical cross section to engage the correspondingly deformed end of the tube 17, but in the case in which the tube end is maintained round or circular the head 77 may of course be of circular cross section. The head 77 in the present instance comprises a sleeve 78 with a circular bore slidable axially on the rod end 76 and having an outer surface which is elliptical in cross sectional profile An O-ring 79 is captured within the sleeve 78 to disallow flow of high pressure liquid externally of the rod 61. The inner side of the sleeve 78 adjacent its forward end is formed with an annular recess 81, the rear side of which provides a stop surface 81*a*.

Figure 5:
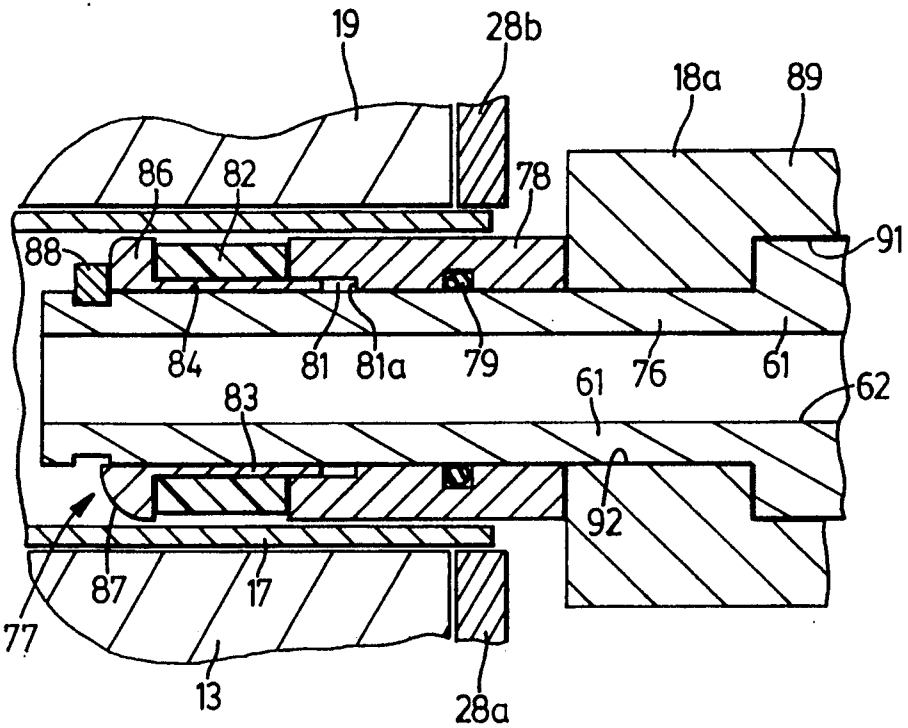

In the preferred form as shown, an elastomeric ring member 82 likewise with an elliptical outer profile and a circular section bore, is disposed over a collar member 83 having a thin annular collar portion 84 extending inwardly a small distance beyond the inner end of the elastomeric member 82 and normally spaced from the stop surface 81*a* as seen in FIG. 5, and an inner shoulder portion 86 having a circular inner bore and elliptical outer profile. The collar 83 is axially slidable on the rod 61 and preferably its forward end is smoothly convexly rounded as seen at 87 to facilitate insertion into the open end of the tube 17. A C-shaped nose retainer clip 88 seats in a correspondingly shaped slot in the end of the rod end portion 76 and maintains the shoulder portion 86 in lightly compressed condition against the elastomeric member 82. In such condition, the outer side of the elastomeric member 82 is preferably nested inwardly between the peripheries of the shoulder 86 and sleeve 78 as seen in FIG. 5.

Figure 6:
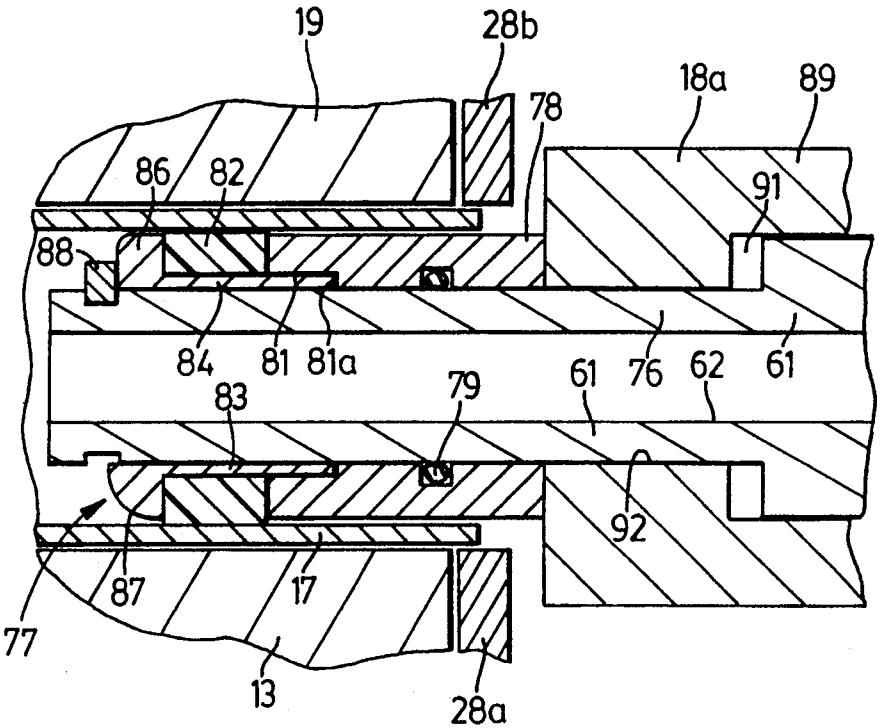
FIGS. 5 and 6 are enlarged cross sections of the sealing head of the pressurization device in non-sealing and sealing states, respectively.

In use, the seal head 77 is inserted into the open end of the tube 17 to be sealed, by extension of the rod 61, as seen in FIGS. 4 and 5. Blocking means, such as the circular portion 18*a* are then applied to the sleeve 78 to resist its retraction while the rod 61 is retracted. such blocking means may be, for example, as described in the above-mentioned Klages et al patent application Ser. No. 07/860,553, filed Mar. 30, 1992, the disclosures of which are incorporated herein by reference, or may be the preferred form of blocking means described hereinafter in more detail especially with reference to FIG. 3. As the shoulder portion 86 retained by the clip 88 retracts relative to the sleeve 78, the elastomeric member 82 is deformed compressively to expand radially outwardly into sealing contact with the inner side of the tube 17. The collar portion 84 closes on the stop surface 81*a* as seen in FIG. 6 to limit the deformation force applied to the seal member 82 and to avoid risk of damage to the seal member and excessive forces being applied to the wall of the tube 17.

Various modifications may of course be made. For example, although with considerably less advantage instead of having a collar portion 84 engaging a stop surface 81*a* other forms of stop member on or connected to the rod 61 may be used engageable against a stop surface on or connected to the sleeve 78. Alternatively, external forms of compression limiting device may be used as described in the Klages et al patent application Ser. No. 07/860,553 referred to above. Moreover, instead of sealing on the inner wall of a tube 17 the seal head 77 and sliding force-limiting collar 83 as described in detail above may be modified as will be appreciated by those skilled in the art to form a seal on the outer side of the wall of the tube 17, as described and shown in the above-mentioned Klages et al application Ser. No. 07/860,553.

In such case, as will be appreciated the outer sleeve portion may engage and displace a collar similar to the collar 83 while the inner rod portion may provide the stop surface engaged by the collar at the limit of compression of the elastomer seal.

Figure 3:
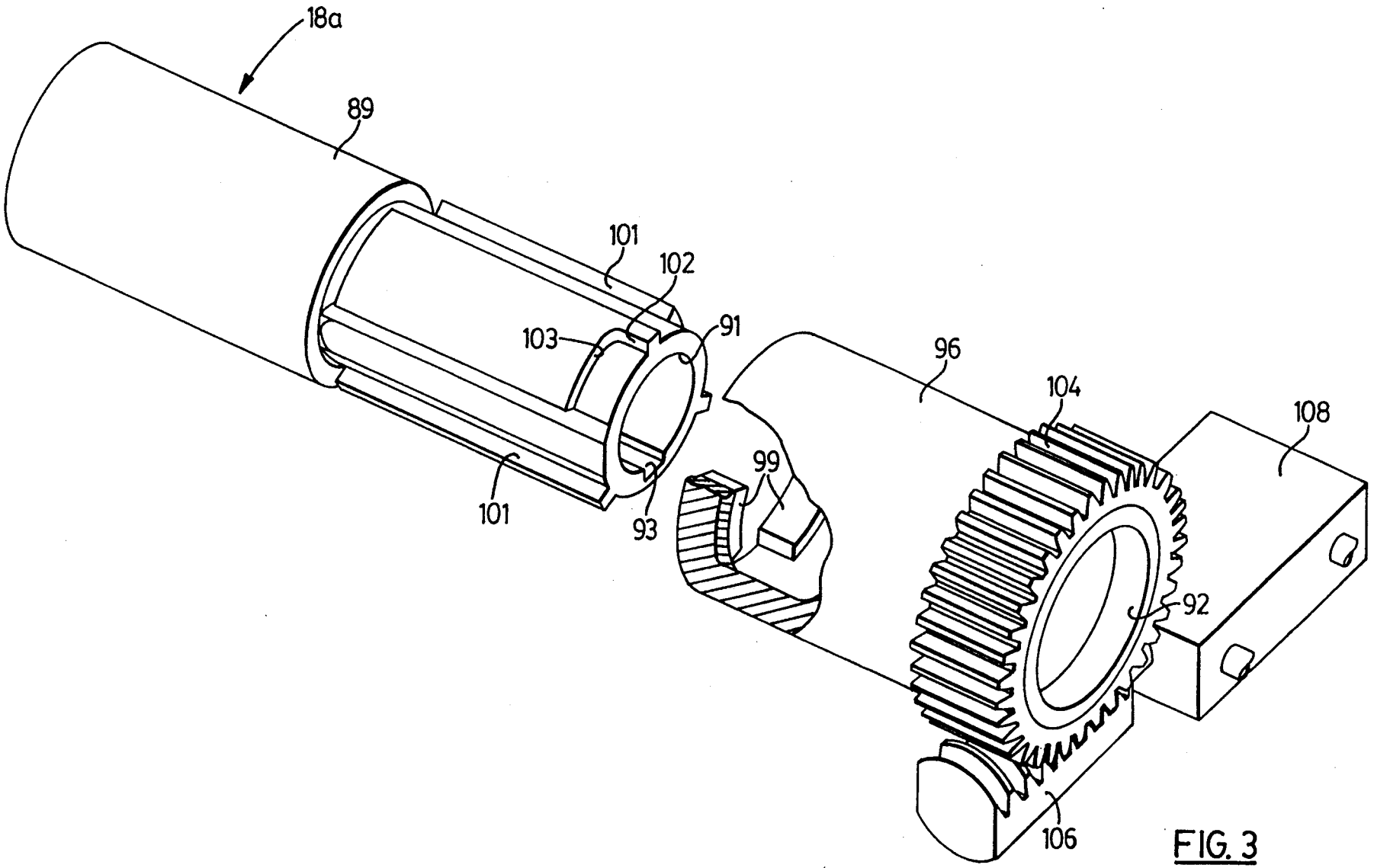
FIG. 3 is a partial perspective and exploded view of a blocking device used in the apparatus of FIGS. 1 and 2.

In the preferred form, the blocking portion 18*a* comprise a cylinder 89 as seen in FIG. 3 having a bore therethrough having a relatively wide rear portion 91 which accommodates the main portion of the rod 61 and a narrower front portion 92 which accommodates the narrow front end portion 76. The cylinder 89 is normally maintained in engagement with the front edge of the main portion of rod 61 as seen in FIG. 5 by the compressive force exerted by the clip 88. The bore portion 91 is formed with a slot or keyway 93 slidably receiving a key 94 secured to the rod 61 whereby the cylinder is non-rotatable relative to the rod 61 and hence also relative to the surroundings. The cylinder 89 is thereby prevented from twisting the components of the seal head 77 around the axis of the rod 61 out of alignment with the aperture defined between section 13 and member 19 or between walls 28*a* and 28*b*.

The cylinder 89 is received telescopingly within an outer cylinder 96 which is housed within the wider front portion 44 of the bore within the block 32, and the cylinder 96 has a reduced diameter inner rear end portion 97 which journals on or relative to gland member 57. The outer side of the front end of the cylinder 96 is retained and supported rotatable within a guide bushing 98 connected on front of the block 32.

The inner side of the outer cylinder 96 is formed with a series of radially inwardly projecting abutment members 99, for example three members 99, spaced equiangularly with respect to the axis of the cylinder 96. The outer side of a rear portion of the cylinder 89 is formed with a like number of equally spaced axially extending channels 101 within which the members 99 can normally run freely as the cylinder 89 telescopes in and out of the cylinder 96. Each channel 101 terminates at the rear end in a circumferentially extending recess 102 providing a radially extending stop surface 103.

For rotating the cylinder 96 about its axis, a ring gear 104 is secured on the inner end of the outer surface of the cylinder 96. The gear 104 is driven by a toothed rack 106 running in a transverse slot 107 in the block 32. A reciprocating drive 108, for example an indexing cylinder and piston arrangement is connected to the rack 106 whereby the rack 106 may be reciprocated to drive the gear 104 and hence the outer cylinder 96 in oscillatory rotation about its ring.

In a typical cycle of operation of the apparatus, starting with the fill and pressurization apparatus in the position shown in FIGS. 1 and 2, a tubular usually cylindrical blank 17 is placed between the die portions 11 and 12 in open condition as seen in FIG. 1. The portions 11 and 12 are then closed together to an intermediate position so that the end of the tube 17 is deformed to an elliptical cross section and gripped between an outer or throat portion of the lower cavity portion 14 and the member 19, as well as between the walls 38*a* and 28*b* as the upper section 27*b* drops onto and seals with the lower section 27*a* to form the box-like enclosure 27 as seen in FIG. 2. The tube 17 is then filled with liquid through the conduit 38 in the high flow low pressure fill operations described above. Before this fill, the valving 73 connected to the bore 62 of the rod 61 is closed.

Pressure is applied to the cylinder housing the piston 63 so that the rod 61 is driven forwardly as seen in FIG. 4 so that the seal head 77 enters the end of the tube 17 as seen in FIGS. 4 and 5. As it moves forward, the rod 61 gathers the cylinder 89 which extends out of the cylinder 96 as seen in FIG. 4. The drive 108 is operated to rotate the cylinder 96 and engage the abutment members 99 in the recesses 102. The drive to the piston 63 is reversed tending to retract the rod 61 rearwardly as seen in FIG. 6. Return movement of the sleeve 78 and cylinder 89 is blocked by engagement of the abutment members 99 on the stop surfaces 103 so that the compression and sealing of the elastomer member 82 within the tube 17 described above takes place. As will be appreciated, a similar gripping, deformation, sealing and pressurization arrangement is employed at each end of the tube 17, with the result that the sealing effected by the seal heads 77 isolates the interior of the tube 17 from the interior of the box-like enclosures 27 and the high flow—low pressure circuit 41.

The valving 73 and low flow—high pressure source 74 are operated to apply a pre-pressure to the interior of the tube 17, for the purpose of avoiding pinching of the tube 17 between the upper and lower die sections 16 and 13 on full closure as described in the above-mentioned U.S. Pat. No. Re. 33990. The sections 13 and 16 are closed fully, and the pressure attained within the tube 17 may be limited during die closure by a pressure relief valve connected to the line 72 or included in the valving 73. During full closure, the clamp member 19 is displaced upwardly somewhat relative to the upper die section 16 against the action of the springs 23. The pressure relief valve is then disabled and the high pressure source 74 operated to apply pressure to the tube 17 sufficient to expand it permanently to the shape of the die cavity formed between the sections 13 and 16.

The pressure within the tube 17 is relieved, drive 108 is operated to unblock return movement of the cylinder 89 and the piston 63 driven rearwardly to the position of FIG. 2. The portions 11 and 12 are opened, the formed blank 17 is removed and the above described cycle of operation can then be repeated.

We claim:

1. A fill and pressurization apparatus for filling and pressurizing a hollow tube through an open end thereof comprising:

(a) a lower die section;

(b) an upper die section disposed adjacent and movable relative to said lower die section;

(c) a sectional fluid conductor disposed adjacent said lower die section, said sectional fluid conductor including a first conductor section fixed relative to said lower die section, and at least one further conductor section movable with said upper die section relative to said lower die section and relative to said first conductor section between relatively open and closed positions, an inlet in the first conductor section communicable with a high flow—low pressure circuit, and said sectional conductor in the closed position of said at least one further conductor section being configured for defining a fluid conduit between the circuit and the open end of the tube; and (d) a movable shaft disposed adjacent said sectional fluid conductor, said movable shaft having a bore communicable with a low flow—high pressure circuit, said shaft movable into a pressurizing position communicating said bore with the interior of the hollow tube and separating said fluid conduit therefrom.

2. Apparatus as claimed in claim 1 wherein said sectional conductor in the closed position of said at least one further conductor section defines an opening on a front side of said sectional conductor adjacent said lower die section adapted to snugly engage an outer surface of the tube.

3. Apparatus as claimed in claim 2 wherein said first conductor section has an opening in its front side having an extent sufficient to receive one half of a perimeter of the hollow tube.

4. Apparatus as claimed in claim 2 wherein the shaft reciprocates sealingly toward said pressurizing position through an opening in a rear side of said first conductor section.

5. Apparatus as claimed in claim 4 wherein said further conductor section moves in a first direction between said relatively open and closed positions and said first conductor section has a front side adjacent said lower die section that is of relatively small height, measured in said first direction, a rear side spaced from said lower die section that is of relatively large height, measured in said first direction, and side walls having surfaces opposable with said at least one further conductor section, said surfaces of said side walls inclining in the direction toward said at least one further conductor section in a rearward direction.

6. Apparatus as claimed in claim 5 wherein said surfaces are provided with a resiliently deformable seal member.

7. Apparatus as claimed in claim 3 wherein said opening is semi-elliptical.

8. Apparatus as claimed in claim 1 wherein said lower die section is fixed, the first conductor section is connected to said fixed lower die section, and said at least one further conductor section is connected to said upper movable die section.

9. Apparatus for sealing a hollow tube comprising a shaft having a rod, a sleeve disposed outwardly of the rod and an endless elastomeric seal member disposed around the rod and adapted to be compressed between opposing compression surfaces provided on the rod and sleeve respectively, means provided for advancing and retracting said shaft toward and away from a tube to be sealed, means provided for blocking retraction of one of the rod and the sleeve whereby when the shaft is retracted the rod and sleeve are displaced axially relative to one another and the seal member is compressed between said compression surfaces and extends in a radial direction to engage sealingly on a surface of the tube, and means provided for limiting the compression applied to the seal member, said compression limiting means comprising a stop surface provided on one of the rod and sleeve and a stop member on the other of the rod and sleeve and moving therewith and engaging the stop surface on predetermined axial relative movement between the rod and sleeve, wherein the stop member comprises a collar disposed between the seal member and said other of the rod and sleeve and the stop surface faces axially toward the collar.

10. Apparatus as claimed in claim 9 wherein the collar comprises a shoulder projecting in a radial direction engaging an end surface of the seal member.

11. Apparatus as claimed in claim 10 adapted to seal an inner surface of the tube, wherein said collar is disposed adjacent one end of the rod and the seal member and sleeve are disposed axially inwardly therefrom.

12. Apparatus as claimed in claim 10 wherein the collar is received in a circumferentially extending recess formed in said one of the rod and sleeve.

13. Apparatus as claimed in claim 9 wherein the rod has a bore therein for communicating a high pressure to the sealed hollow tube.

14. Apparatus for sealing a hollow tube comprising a rod, a sleeve disposed outwardly of the rod, an endless elastomeric seal member disposed around the rod, means provided for retracting one of the rod and sleeve and means provided for blocking retraction of the other of the rod and sleeve whereby the rod and sleeve are displaced axially relative to one another and the seal member compressed to extend in a radial direction for sealing on a tube surface, said blocking means comprising two cylinders telescoping between extended and retracted conditions and means for resisting thrust forces applied to said cylinder in said extended condition, said cylinders engaging said other of the rod and sleeve, one cylinder provided with abutment members extending radially and running in axially extending channels provided in the other cylinder, stop surfaces extending circumferentially from the channels adjacent the abutment members in said extended position of the cylinders relative to one another, and means provided for rotating the cylinders relative to one another whereby the abutment members can be lodged on the stop surfaces to block telescoping movement of the cylinders.

15. Apparatus as claimed in claim 14 wherein the abutment members are provided on an inner surface of an outer telescoping cylinder and the channels and stop surfaces on the outer side of an inner telescoping cylinder.

16. Apparatus as claimed in claim 15 including a ring gear on the outer cylinder and a rack engaging the ring gear and reciprocating laterally of the cylinder for effecting rotation of the outer cylinder.

17. Apparatus as claimed in claim 14 having means keying said other of the rod and sleeve non-rotatively relative to one of said telescoping cylinders.

18. Apparatus as claimed in claim 17 wherein the seal member is elliptical in cross-section.

19. Apparatus as claimed in claim 14 comprising a cylinder block mounting said telescoping cylinders and having said one of the rod and the sleeve passing therethrough and having a piston provided thereon working in a cylinder formed in the cylinder block, whereby said one of the rod and the sleeve may be reciprocated.

* * * * *